US009989067B2

(12) United States Patent
Fujisono et al.

(10) Patent No.: US 9,989,067 B2
(45) Date of Patent: Jun. 5, 2018

(54) AIR BLOWER

(71) Applicant: Panasonic Intellectual Property Management Co., Ltd., Osaka (JP)

(72) Inventors: Takashi Fujisono, Aichi (JP); Ippei Oda, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 250 days.

(21) Appl. No.: 14/773,166

(22) PCT Filed: Feb. 28, 2014

(86) PCT No.: PCT/JP2014/001086
§ 371 (c)(1),
(2) Date: Sep. 4, 2015

(87) PCT Pub. No.: WO2014/141613
PCT Pub. Date: Sep. 18, 2014

(65) Prior Publication Data

US 2016/0017892 A1 Jan. 21, 2016

(30) Foreign Application Priority Data

Mar. 13, 2013 (JP) ..... 2013-050036

(51) Int. Cl.
*F04D 29/44* (2006.01)
*F04D 29/54* (2006.01)
(Continued)

(52) U.S. Cl.
CPC ..... *F04D 29/4206* (2013.01); *F04D 17/08* (2013.01); *F04D 17/16* (2013.01);
(Continued)

(58) Field of Classification Search
CPC .. F04D 29/4206; F04D 29/053; F04D 29/162; F04D 29/281; F04D 17/08; F04D 17/16; F04D 25/08
(Continued)

(56) References Cited

U.S. PATENT DOCUMENTS

2005/0226721 A1 10/2005 Higashida
2013/0121818 A1* 5/2013 Shichiken ..... F04D 17/16 415/204

FOREIGN PATENT DOCUMENTS

JP H08-100790 A 4/1996
JP 3698150 B 9/2005
(Continued)

OTHER PUBLICATIONS

International Search Report of PCT application No. PCT/JP2014/001086 dated Apr. 8, 2014.
(Continued)

*Primary Examiner* — Laert Dounis
*Assistant Examiner* — Kelsey Stanek
(74) *Attorney, Agent, or Firm* — Pearne & Gordon LLP

(57) ABSTRACT

Blower includes: scroll casing, centrifugal impeller and a motor. Scroll casing includes: recessed portion formed outside lateral plate concentrically with centrifugal impeller; inner-circumferential flat portion disposed more on an inner circumference than recessed portion; and outer-circumferential flat portion disposed more on an outer circumference than recessed portion. Bottommost surface of recessed portion is disposed on a same plane as lateral plate end surface of lateral plate. Angle θa made by inner-circumferential flat portion and recessed portion inner surface of recessed portion on an inner circumference is set to a value which falls within a range of 90° or more to 120° or less.

4 Claims, 4 Drawing Sheets

(51) Int. Cl.

| | |
|---|---|
| ***F04D 29/42*** | (2006.01) |
| ***F04D 17/16*** | (2006.01) |
| ***F04D 29/16*** | (2006.01) |
| ***F04D 17/08*** | (2006.01) |
| ***F04D 25/08*** | (2006.01) |
| ***F04D 29/053*** | (2006.01) |
| ***F04D 29/28*** | (2006.01) |

(52) U.S. Cl.
CPC ..... *F04D 25/08* (2013.01); *F04D 29/053* (2013.01); *F04D 29/162* (2013.01); *F04D 29/281* (2013.01)

(58) Field of Classification Search
USPC ..... 415/204, 203, 206, 182.1
See application file for complete search history.

(56) References Cited

FOREIGN PATENT DOCUMENTS

| | | | | |
|---|---|---|---|---|
| JP | 2011-226408 | | | 11/2011 |
| JP | 2011226408 | A | * | 11/2011 |
| WO | 2011/148578 | | | 12/2011 |

OTHER PUBLICATIONS

Translation of Search Report issued in Chinese Patent Application No. CN 201480013606 dated Feb. 8, 2017.

* cited by examiner

PRIOR ART

AIR BLOWER

This application is a U.S. national stage application of the PCT international application No. PCT/JP2014/001086.

TECHNICAL FIELD

The present invention relates to a blower.

BACKGROUND ART

Conventionally, a blower which is used in a ceiling-embedded type ventilation fan or the like includes an orifice having a bellmouth-shaped inflow port (see PTL 1, for example). Hereinafter, the blower is described with reference to FIG. 4.

FIG. 4 is a constitutional view showing a cross section of a conventional blower. As shown in FIG. 4, multi-blade blower 110 includes: impeller 113 and bellmouth 112. Multi-blade blower 110 sucks a gas along the direction of axis of rotation O-O, and blows out a fluid in the direction which intersects with axis of rotation O-O. Bellmouth 112 has: suction port 112*a* disposed so as to face impeller 113; and recessed portion 112*d* which is indented toward impeller 113 side around suction port 112*a* and forms a negative pressure space therein. In multi-blade blower 110 having such a configuration, turbulence of the flow of air sucked into an area in the vicinity of suction port 112*a* is suppressed. Further, in multi-blade blower 110, it is possible to suppress turbulence generated by a circulation flow which is a flow of a gas sucked into impeller 113 again after being blown out from impeller 113 once and hence, a noise is reduced.

CITATION LIST

Patent Literature

PTL 1: Japanese Patent No. 3698150

SUMMARY OF THE INVENTION

In such a conventional blower, the negative pressure space formed in recessed portion 112*d* is disposed at a position which overlaps with impeller 113. Accordingly, blades 133 of impeller 113 are to be cut away along a curved portion 112*b* of recessed portion 112*d* and hence, there has been a drawback that a blowout port of impeller 113 is narrowed, thus lowering air blowing efficiency.

Accordingly, a blower of the present invention includes: a scroll casing having a bellmouth-shaped inflow port and an outflow port; and a centrifugal impeller and a motor disposed in the inside of the scroll casing, the motor being configured to drive the centrifugal impeller. The centrifugal impeller includes: a main plate fixed to a rotary shaft of the motor; a plurality of blades annularly disposed on the main plate; a lateral plate disposed on an outer circumference of the plurality of blades, and fixing the plurality of blades; a suction port formed on an inner circumference of the plurality of blades; and a blowout port formed on an outer circumference of the plurality of blades. The scroll casing includes: a recessed portion formed outside the lateral plate concentrically with the centrifugal impeller; an inner-circumferential flat portion disposed more on an inner circumference than the recessed portion; and an outer-circumferential flat portion disposed more on an outer circumference than the recessed portion. A bottommost surface of the recessed portion is disposed on a same plane as a lateral plate end surface of the lateral plate. Angle θa made by the inner-circumferential flat portion and a recessed portion inner surface of the recessed portion on an inner circumference is set to a value which falls within a range of 90° or more to 150° or less.

In the blower having such a configuration, extremely small vortices are generated from a connection portion between the inner-circumferential flat portion and the recessed portion inner surface of the recessed portion on an inner circumference, and the vortices cover a surface of the blower ranging from the recessed portion to a bellmouth. Accordingly, peeling of the flow of air (the flow of air along a wall surface) which flows into the blower along the bellmouth-shaped inflow port can be suppressed. Further, the generation of large turbulence caused due to peeling of the air flow can be suppressed so that turbulence of the flow which flows into the centrifugal impeller is suppressed. Further, it is possible to suppress the circulation flow where air blown out from the blowout port of the centrifugal impeller flows along a bottommost surface of the recessed portion and returns to the suction port again. Accordingly, turbulence of the flow which flows into the centrifugal impeller and noise can be suppressed. Further, there is no possibility that the blades are to be cut away due to the formation of the recessed portion, and the blowout port of the blade can be set to the same height as the suction port and hence, there is no possibility that the blowout port of the centrifugal impeller is narrowed and air blowing efficiency is lowered.

DESCRIPTION OF EMBODIMENT

Hereinafter, exemplary embodiments of the present invention are described with reference to drawings.

First Exemplary Embodiment

Figure 1A:
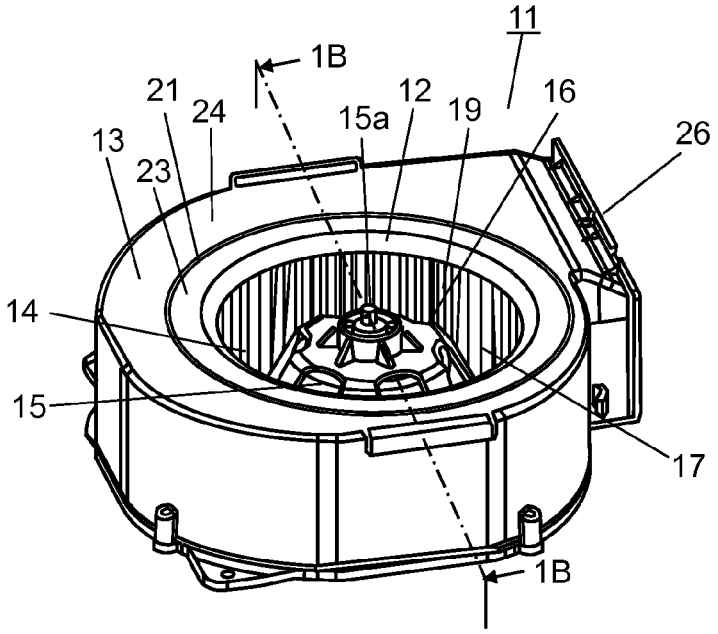
FIG. 1A is a perspective view showing a blower of a first exemplary embodiment of the present invention.
Figure 1B:
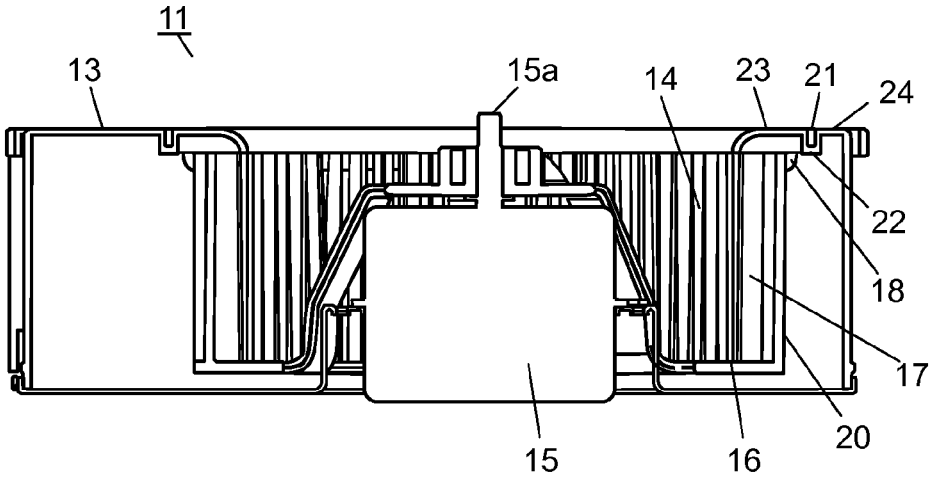
FIG. 1B is a cross-sectional view taken along a line 1B-1B in FIG. 1A.

FIG. 1A is a perspective view showing a blower of a first exemplary embodiment of the present invention, and FIG. 1B is a cross-sectional view taken along a line 1B-1B in FIG. 1A. As shown in FIG. 1A and FIG. 1B, blower 11 includes: scroll casing 13; centrifugal impeller 14; and motor 15. In this exemplary embodiment, scroll casing 13 has bellmouth-shaped inflow port 12 and outflow port 26. Centrifugal impeller 14 and motor 15 are disposed in the inside of scroll casing 13. Motor 15 drives centrifugal impeller 14.

Centrifugal impeller 14 has: main plate 16; a plurality of blades 17; lateral plate 18; suction port 19; and blowout port 20. In this exemplary embodiment, main plate 16 is fixed to rotary shaft 15*a* of motor 15. The plurality of blades 17 are annularly disposed on main plate 16. Lateral plate 18 is disposed on outer peripheries of the plurality of blades 17 and fixes the plurality of blades 17 to each other. Suction port 19 is positioned on an inner circumference of the plurality of blades 17. Blowout port 20 is positioned on an outer circumference of the plurality of blades 17, and air sucked through suction port 19 is blown out from blowout port 20.

Recessed portion 21 is formed in scroll casing 13 outside lateral plate 18 concentrically with centrifugal impeller 14, and a bottom portion of recessed portion 21 projects toward a centrifugal impeller 14 side. Scroll casing 13 has inner-circumferential flat portion 23 disposed more on an inner circumference of scroll casing 13 than recessed portion 21 and outer-circumferential flat portion 24 disposed more on an outer circumference of scroll casing 13 than recessed portion 21.

Figure 2:
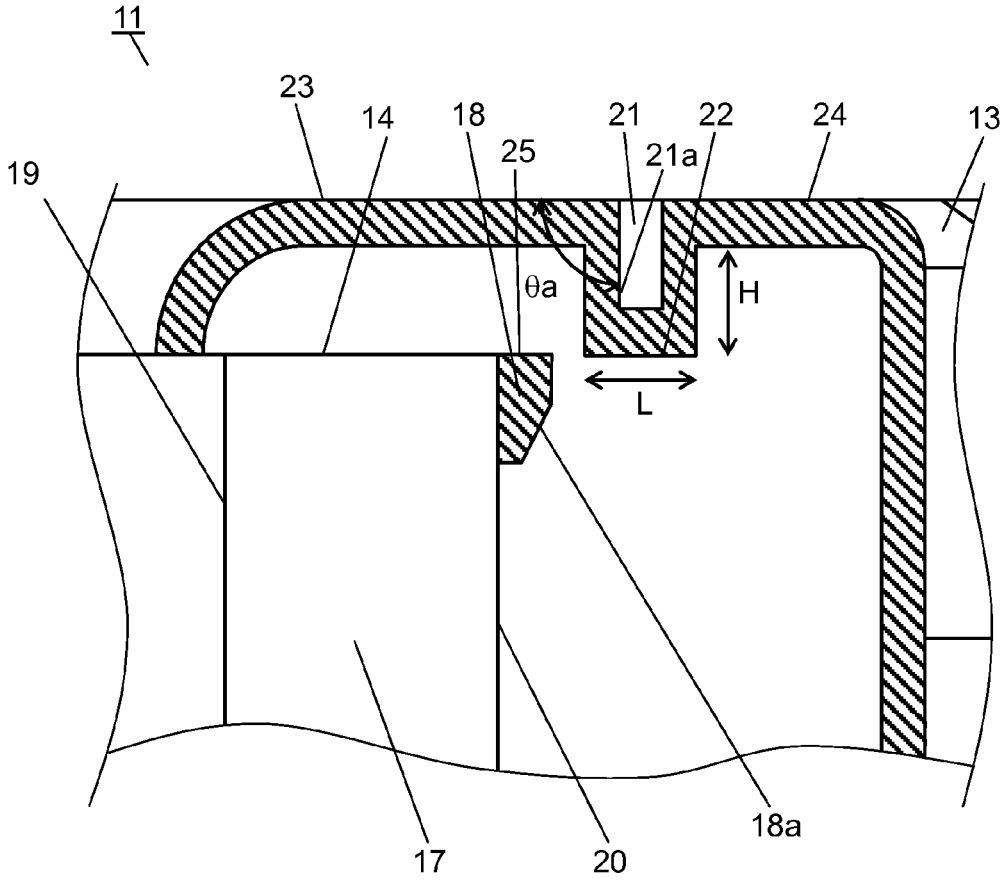
FIG. 2 is a constitutional view showing a cross section of the blower of the first exemplary embodiment of the present invention at a position in the vicinity of an inflow port.

FIG. 2 is a constitutional view showing a cross section of the blower of the first exemplary embodiment of the present invention at a position in the vicinity of the inflow port. As shown in FIG. 2, bottommost surface 22 forms a bottom portion of scroll casing 13 on which recessed portion 21 is formed. Bottommost surface 22 is disposed on the same plane as lateral plate end surface 25 of lateral plate 18. Recessed portion 21 is formed on scroll casing 13 more on an outer circumference than an outer periphery of lateral plate 18 with a predetermined distance between recessed portion 21 and lateral plate 18. In a cross section of centrifugal impeller 14 in the radial direction, angle θa made by inner-circumferential flat portion 23 and recessed portion inner surface 21*a* of recessed portion 21 on an inner circumference is set to 90°. In this exemplary embodiment, by disposing bottommost surface 22 at a position away from lateral plate end surface 25 by an amount corresponding to 20% or more and 50% or less of a thickness of lateral plate 18 shown in FIG. 1B in the direction of rotary shaft 15*a*, it is possible to acquire advantageous effects substantially equal to advantageous effects which blower 11 can acquire when bottommost surface 22 and lateral plate end surface 25 are disposed on the same plane.

Air which flows into blower 11 through inflow port 12 shown in FIG. 1A is sucked into centrifugal impeller 14 through suction port 19, and is blown out from blowout port 20 shown in FIG. 1B. Then, the air is flown out from scroll casing 13 by passing through outflow port 26 shown in FIG. 1A.

As shown in FIG. 2, an outer circumference of lateral plate 18 is formed of inclined surface 18*a*.

In blower 11 shown in FIG. 2 which has the above-mentioned configuration, extremely small vortices are generated from a connection portion between inner-circumferential flat portion 23 and recessed portion inner surface 21*a*. The vortices cover the surface ranging from recessed portion 21 to inflow port 12 shown in FIG. 1A and hence, peeling off of the air flow which flows into scroll casing 13 along bellmouth-shaped inflow port 12 (the flow along a wall surface) can be suppressed. Accordingly, turbulence of the flow which flows into centrifugal impeller 14 can be suppressed and a noise is reduced.

In the inside of scroll casing 13 shown in FIG. 1B, air blown out from blowout port 20 of centrifugal impeller 14 flows along bottommost surface 22 of recessed portion 21. As a result, the circulation flow which returns to suction port 19 shown in FIG. 1A again is suppressed so that the turbulence of the flow which flows into centrifugal impeller 14 can be suppressed whereby a noise is reduced. Further, there is no possibility that blade 17 is to be cut away due to the formation of recessed portion 21 and hence, blowout port 20 of blade 17 can be set to the same height as suction port 19. Accordingly, there is no possibility that blowout port 20 of centrifugal impeller 14 is narrowed so that air blowing efficiency is lowered.

In the first exemplary embodiment, a distance between recessed portion inner surface 21*a* of recessed portion 21 disposed on an inner circumference of scroll casing 13 shown in FIG. 2 and an outer circumferential surface of lateral plate 18 is set to a value approximately 3% of an outer diameter of lateral plate 18. However, it is preferable to set such a distance to a value as small as possible. It is sufficient that lateral plate 18 and recessed portion 21 which projects to the inside of scroll casing 13 are not brought into contact with each other when centrifugal impeller 14 is rotated.

In the first exemplary embodiment, angle θa is set to 90°. However, angle θa is determined based on a magnitude of a gradient set for the removal of a product from a mold in manufacturing the product using the mold and on a performance of blower 11. Angle θa is preferably set to a value which falls within a range of 90° or more to 120° or less. When angle θa is set to a value smaller than 90°, the removal of a product from the mold becomes difficult at the time of forming scroll casing 13 using a resin or the like. On the other hand, when angle θa is set to a value larger than 120°, it becomes difficult to generate extremely small vortices from the connection portion between inner-circumferential flat portion 23 and recessed portion inner surface 21*a*.

As shown in FIG. 2, it is sufficient that length L of bottommost surface 22 in the radial direction is set equal to projection height H of recessed portion 21 or is set smaller than a value two times as large as projection height H of recessed portion 21.

In blower 11 shown in FIG. 2 having such a configuration, air blown out from blowout port 20 easily flows along bottommost surface 22 so that the circulation flow is suppressed.

Inner-circumferential flat portion 23 and outer-circumferential flat portion 24 shown in FIG. 1B are equal in height in the direction of rotary shaft 15*a*. That is, inner-circumferential flat portion 23 and outer-circumferential flat portion 24 are formed on the same plane.

In blower 11 having such a configuration, even when scroll casing 13 cannot ensure a sufficient height, the increase of a pressure loss in an air flow passage due to the projecting of recessed portion 21 toward the inside of scroll casing 13 can be suppressed to a minimum level. As a result, the lowering of air blowing efficiency of centrifugal impeller 14 can be suppressed to a minimum level so that a noise can be reduced.

Second Exemplary Embodiment

In a second exemplary embodiment of the present invention, constitutional elements identical to constitutional elements in the first exemplary embodiment are given the same symbols and the detailed explanation of the identical parts is omitted, and only different parts are described.

Figure 3:
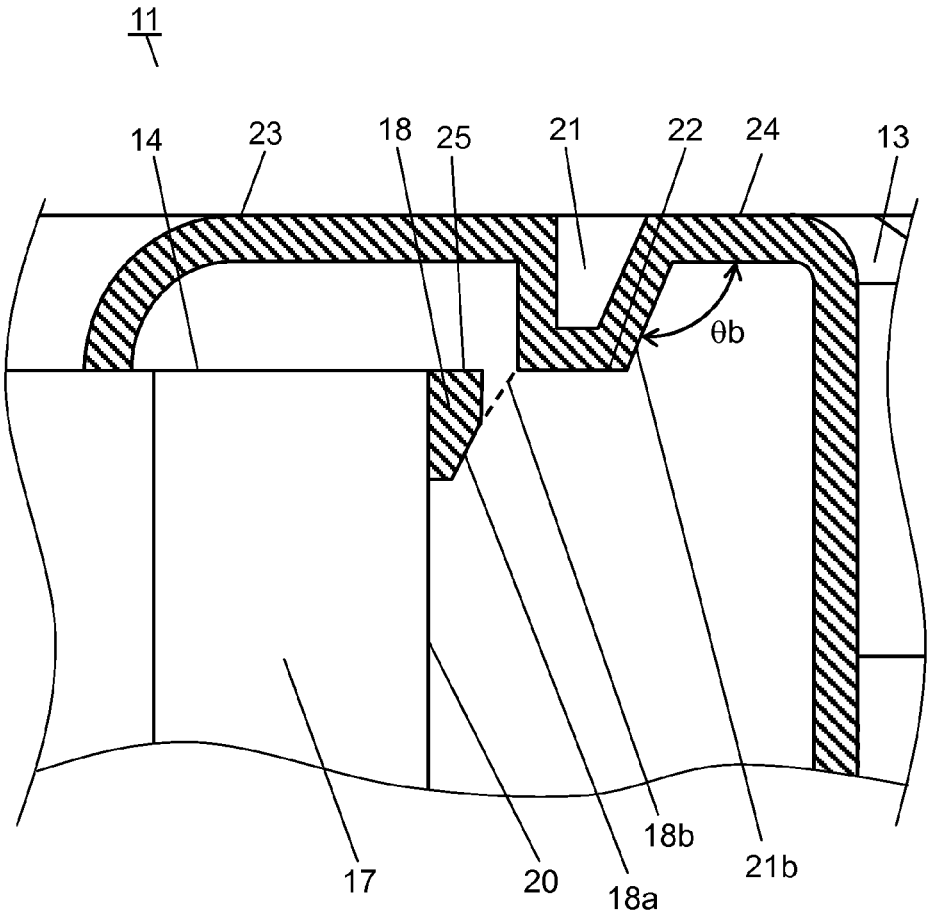
FIG. 3 is a constitutional view showing a cross section of a blower according to a second exemplary embodiment of the present invention at a position in the vicinity of an inflow port.
Figure 4:
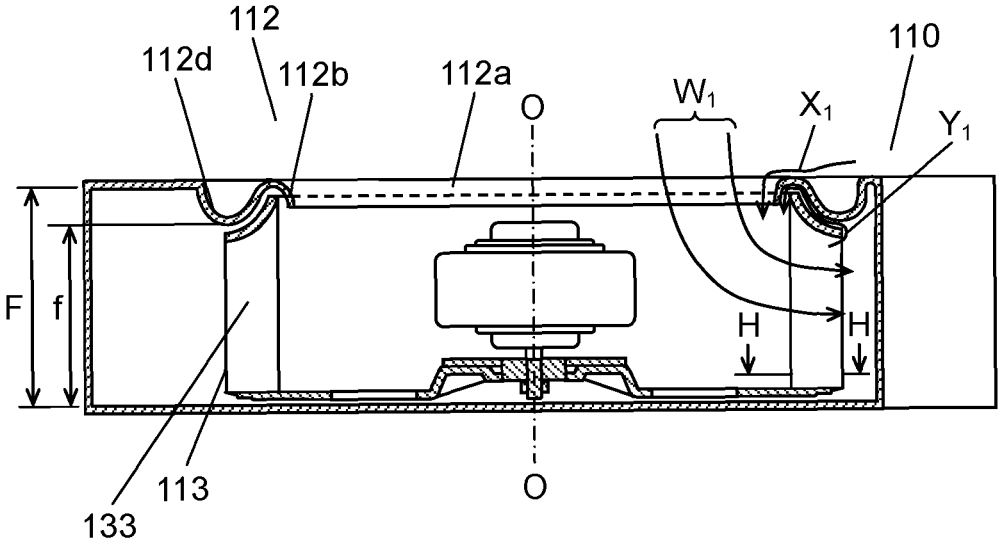
FIG. 4 is a constitutional view showing a cross section of a conventional blower.

FIG. 3 is a constitutional view showing a cross section of a blower of the second exemplary embodiment of the present invention at a position in the vicinity of an inflow port. FIG. 3 shows a cross section of centrifugal impeller 14 in the radial direction in the case where angle θb made by outer-circumferential flat portion 24 and recessed portion outer surface 21*b* of recessed portion 21 on an outer circumference is set to a large angle.

By setting angle θb to the large angle, the generation of turbulence which occurs when an air flow which flows along bottommost surface 22 leaves bottommost surface 22 can be suppressed to a minimum level so that the increase of a noise can be suppressed.

Angle θb is determined by taking into account a balance between a noise and air blowing efficiency. Angle θb is preferably set to a value which falls within a range of 90° or more to 150° or less. The larger angle θb, the smaller the generation of turbulence of the flow separated from bottommost surface 22 becomes and hence, the increase of a noise can be suppressed. Further, the smaller angle θb, the more effectively a volume in scroll casing 13 can be made use of and hence, the deterioration of air blowing efficiency of centrifugal impeller 14 due to the increase of a pressure loss in an air flow passage of scroll casing 13 can be suppressed to a minimum level.

Further, an outer circumference of lateral plate 18 is formed of inclined surface 18*a*, and extension 18*b* of inclined surface 18*a* intersects with bottommost surface 22 in a cross section of centrifugal impeller 14 in the radial direction.

In blower 11 having such a configuration, air blown out from blowout port 20 flows along a profile of lateral plate 18 thus easily flowing along bottommost surface 22. As a result, the circulation flow is suppressed, and a noise can be reduced.

INDUSTRIAL APPLICABILITY

The blower of the present invention is useful as a blower used in a ventilation blower, air conditioning equipment or the like.

REFERENCE MARKS IN THE DRAWINGS

11 blower
12 inflow port
13 scroll casing
14 centrifugal impeller
15 motor
15*a* rotary shaft
16 main plate
17 blade
18 lateral plate
18*a* inclined surface
18*b* extension
19 suction port
20 blowout port
21 recessed portion
21*a* recessed portion inner surface
21*b* recessed portion outer surface
22 bottommost surface
23 inner-circumferential flat portion
24 outer-circumferential flat portion
25 lateral plate end surface
26 outflow port

The invention claimed is:

1. A blower comprising:
a scroll casing having a bellmouth-shaped inflow port and an outflow port; and
a centrifugal impeller and a motor disposed in the scroll casing, the motor being configured to drive the centrifugal impeller, wherein
the centrifugal impeller comprises:
a main plate fixed to a rotary shaft of the motor;
a plurality of blades annularly disposed on the main plate;
a lateral plate disposed on an outer circumference of the plurality of blades, and fixing the plurality of blades;
a suction port formed on an inner circumference of the plurality of blades; and
a blowout port formed on the outer circumference of the plurality of blades,
the scroll casing includes:
a recessed portion formed outside the lateral plate concentrically with the centrifugal impeller;
an inner-circumferential flat portion disposed more on the inner circumference of the plurality of blades than the recessed portion; and
an outer-circumferential flat portion disposed more on the outer circumference of the plurality of blades than the recessed portion, and
angle θa made by the inner-circumferential flat portion and a recessed portion inner surface of the recessed portion on the inner circumference of the plurality of blades is set to a value which falls within a range of 90° or more to 120° or less,
wherein an outer circumference of the lateral plate is formed of an inclined surface, and an extension of the inclined surface intersects with a bottommost surface of the recessed portion.

2. The blower according to claim 1, wherein
a length of a bottommost surface of the recessed portion in a radial direction is set equal to a projection height of the recessed portion or is set smaller than a value two times as large as the projection height of the recessed portion.

3. The blower according to claim 1, wherein
the inner-circumferential flat portion and the outer-circumferential flat portion are equal in height.

4. The blower according to claim 1, wherein
angle θb made by the outer-circumferential flat portion and a recessed portion outer surface of the recessed portion on the outer circumference of the plurality of blades is set to a value which falls within a range of 90° or more to 150° or less.

* * * * *